US005987896A

United States Patent [19]

James et al.

[11] Patent Number: 5,987,896

[45] Date of Patent: Nov. 23, 1999

[54] SYSTEM AND METHOD FOR REGULATING THE FLOW OF A FLUID REFRIGERANT TO A COOLING ELEMENT

[75] Inventors: Timothy W. James, Santa Barbara; Wayne D. Cornelius, San Diego; Freeman H. Rose, Jr., Del Mar, all of Calif.

[73] Assignee: Panadea Medical Laboratories, Carlsbad, Calif.

[21] Appl. No.: 08/911,874

[22] Filed: Aug. 15, 1997

[51] Int. Cl.[6] ..... F17C 3/10

[52] U.S. Cl. ..... 62/48.3; 62/50.1; 62/50.2; 62/51.1

[58] Field of Search ..... 62/48.3, 50.1, 62/50.2, 51.1

[56] References Cited

U.S. PATENT DOCUMENTS 5,250,901 10/1993 Kaufman et al. .

5,291,169 3/1994 Ige et al. .

5,412,363 5/1995 Breneman et al. .

5,414,399 5/1995 Breneman et al. .

OTHER PUBLICATIONS

Chapter 5, entitled Psychrometrics , from the *ASHRAE Handbook of Fundamentals,* pp. 97–101.

*Primary Examiner*—Christopher B. Kilner

*Attorney, Agent, or Firm*—Nydegger & Associates

[57] ABSTRACT

A system for providing a fluid refrigerant to a cooling element is provided herein. The system includes a vessel which holds the fluid refrigerant, a heat source evaporating a portion of the fluid in the vessel, and a heat exchanger condensing a portion of the gaseous phase of the fluid in the vessel. A conduit establishes fluid communication between: (i) the vessel and the cooling element; and (ii) the cooling element and the heat exchanger. Importantly, the system controls the flow rate of the fluid refrigerant to the cooling element by controlling the pressure of the fluid in the vessel. The system is particularly useful with cryogenic fluid refrigerants to cool a superconductor for an MRI System.

35 Claims, 1 Drawing Sheet

SYSTEM AND METHOD FOR REGULATING THE FLOW OF A FLUID REFRIGERANT TO A COOLING ELEMENT

FIELD OF THE INVENTION

The present invention relates to a system and method for supplying a fluid refrigerant to a cooling element. More particularly, the present invention relates to a system for regulating the temperature of a device or an environment by regulating the flow of the fluid refrigerant from a vessel to the cooling element. The present invention is particularly useful for cooling a high temperature superconductor for a magnetic resonance imaging system ("MRI System").

BACKGROUND

Cooling systems are commonly utilized throughout the world for cooling devices and/or environments. As is well known, a cooling system can be to keep occupants in a structure comfortable. A well known example of this type of cooling system is an air conditioner for a home or office.

Alternately, instead of providing comfort to the occupants, many cooling systems are used to enhance or facilitate the operation of a device or a piece of equipment. In fact, a number of devices are unable to properly function without being cooled by a cooling system. For example, devices which utilize superconductors are unable to operate without a cooling system. The term superconductivity refers the state in certain metals, alloys and ceramics in which electrical resistance is zero. In order to attain superconductivity, the certain metal, alloys and ceramics must be cooled to a temperature near or above absolute zero. Importantly, if the temperature of these certain materials raises above the required superconducting temperature, these materials cease to function as a superconductor.

In recent years, the use of superconductors for MRI Systems has become increasingly popular. Typically, the MRI system includes a magnetic coil composed of superconducting wire that is maintained at the required superconducting temperature by a cooling system. The widespread use of superconductors in MRI Systems is due to the ability to offer a combination of high field strength, low power consumption and relatively low mass.

A typical cooling system for a superconductor includes a vessel holding a cryogenic fluid refrigerant. The vessel is utilized to deliver a continuous flow of the cryogenic fluid refrigerant to the superconductor to maintain the superconductor at the required superconducting temperature. A detailed description of one type of cryogenic cooling system for a superconductor of a MRI System is provided in U.S. Pat. No. 5,417,073, which issued to James et al. The contents of U.S. Pat. No. 5,417,073 are incorporated herein by reference.

Unfortunately, present cooling systems lack an easy and reliable way to control the flow of the cryogenic fluid refrigerant to the superconductor. Importantly, if flow of the fluid refrigerant is insufficient, the temperature of the material will rise above the required superconducting temperature and the material will cease to function as a superconductor. Alternately, if too much of the fluid refrigerant is delivered to the superconductor, the cooling system will waste fluid refrigerant. This will result in increased cost for operating the cooling system and reduced operational time for the cooling system.

In light of the above, it is an object of the present invention is to provide a system and method for regulating the flow of a fluid refrigerant from the vessel to the cooling elements of an MRI device or other environment. Yet another object of the present invention to provide a system and method for regulating the temperature of the cooling element which is relatively easy to operate and relatively inexpensive to manufacture. Still another object of the present invention is to provide a system and method for regulating the temperature of the cooling element which requires very few, if any, moving components and is not electrically complicated. Yet another object of the present invention is to provide a cooling system which is more efficient, which is thermally stable and which can operate for longer periods of time than existing cooling systems.

SUMMARY

The present invention is directed to a system for supplying a fluid refrigerant to a cooling element which satisfies these needs. The present system controls the flow of the fluid refrigerant to the cooling system by controlling the pressure in a vessel containing the fluid refrigerant. By controlling the flow of the fluid refrigerant to the cooling element, the system is able to control and maintain the required temperature of the cooling device without providing excessive amounts of the fluid refrigerants. Importantly, the present system is able to control the temperature of the cooling element without utilizing complicated mechanical and electrical devices.

The system includes a regulator which regulates the flow of the fluid from the vessel to the cooling element. The regulator includes a conduit, a pressure reducer and a heat exchanger. The conduit includes a first section and a second section. The first section transfers at least a portion of the fluid from the vessel to the cooling element and includes an inlet port which is in liquid communication with a liquid phase of the fluid. The second section establishes fluid communication between the cooling element and the heat exchanger to transfer at least a portion of the fluid from the cooling element to the heat exchanger. The second section allows the fluid to be fed back or directed to the heat exchanger so that the system operates as a closed loop system.

The pressure reducer reduces the pressure and temperature of the fluid in the cooling element. In one embodiment, the pressure reducer is a flow restrictor positioned in the first section of the conduit for restricting the flow of the fluid in the first section of the conduit.

The heat exchanger condenses at least a portion of the gaseous phase of the fluid in the vessel. By condensing the gaseous phase, the pressure in the vessel is reduced. As pressure in the vessel is reduced, fluid flow to the cooling element is reduced. The heat exchanger is in thermal communication, and more preferably, in direct thermal communication with at least a portion of a gaseous phase of the fluid. In one embodiment, the heat exchanger is positioned within the vessel. Alternately, for example, the heat exchanger can be positioned within a wall of the vessel.

The system can also include a heat source evaporating at least a portion of the fluid in the vessel. As the fluid in the vessel is evaporated, the pressure in the vessel is increased. This increases flow of the fluid to the cooling element. The heat source can include a gas or electric heating element. Alternately, the heat source can include heat radiated through the vessel.

The system can be used to cool a number of alternate objects, devices, or environments including superconductors, superconductors for an MRI device, electronic instruments, measuring devices, communication devices, and/or manufacturing processes.

The invention is also a method for cooling an environment with the fluid refrigerant. The method includes the steps of evaporating liquid phase refrigerant in the vessel, discharging fluid refrigerant to the environment, reducing the temperature of the fluid refrigerant which is transferred to the environment, absorbing heat from the environment into the fluid refrigerant, and drawing heat from gas phase refrigerant in the vessel into the fluid refrigerant in the conduit.

Importantly, the system and method provided herein is able to control the flow of the fluid refrigerants to a cooling element without the use of complicated mechanical and electrical devices. Further, the system is able to easily control the flow of the fluid refrigerant to avoid wasting fluid refrigerant and allow the system to operate more economically and for longer periods of time.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
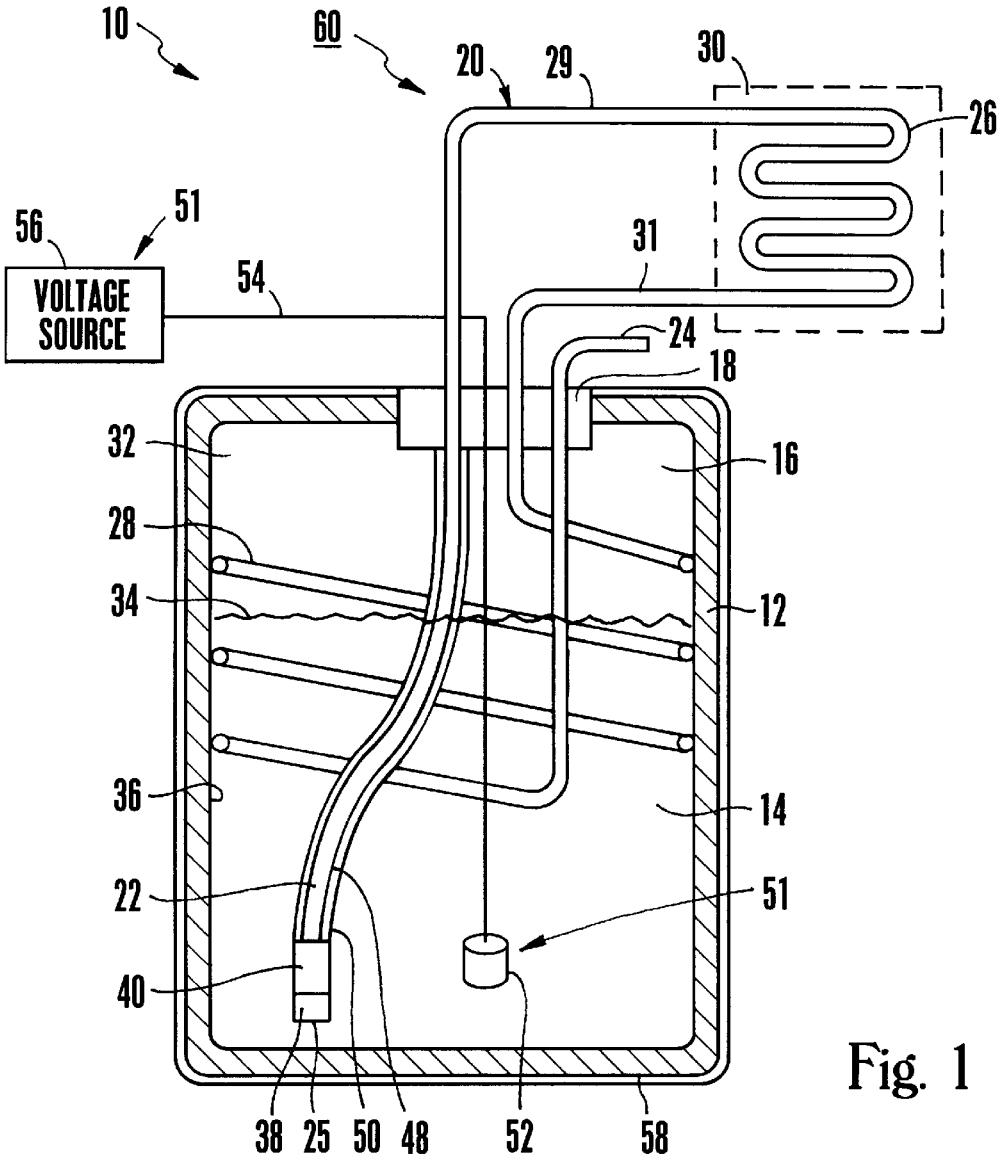
FIG. 1 is a cross-sectional schematic of a cooling system in accordance with the present invention.

Referring initially to FIG. 1, a cooling system in accordance with the present invention is shown and generally designated 10. As shown, the system 10 includes vessel 12 for holding a fluid refrigerant. Specifically, the fluid refrigerant is held in the vessel 12 in both a liquid phase 14 and a gas phase 16. A cap or lid 18 is provided for sealing the fluid refrigerant in the vessel 12 so that the gas phase 16 can be pressurized to the saturation vapor pressure of the fluid refrigerant. Preferably, the vessel 12 is insulated to prevent excessive evaporation of the liquid phase 14.

For purposes of the present invention, the fluid refrigerant can be any suitable fluid. For example, if it is intended that the cooling system provide for extremely cold temperatures, the fluid refrigerant may be a cryogenic fluid such as nitrogen. On the other hand, for more conventional temperatures, a common fluid refrigerant such as water may be used. In yet another embodiment, the fluid refrigerant can be a combination of fluids.

Although the vessel 12 shown in FIG. 1 is of a rather standard structural configuration (impliedly, the vessel 12 shown is cylindrical) it is to be appreciated that the actual configuration and size of the vessel 12 can be varied significantly and are matters of design choice. Thus, vessel 12 may be shaped as necessary to satisfy the particular requirements of the cooling function to be performed. For example, in a configuration, not shown in the drawings, an interconnecting two-chamber vessel may be employed with the liquid phase refrigerant 14 held predominantly in one chamber while the gas phase refrigerant 16 is held predominantly in another chamber. Further, the orientation of the vessel 12 can be varied as required for the particular task. For example, it is intended that the vessel 12 will operate with equal facility when inverted.

FIG. 1 also shows that the system 10 includes a conduit 20 which has a first end 22 and a second end 24. For purposes of the present invention, the conduit 20 can be of any type of tubing or pipe, or a combination of types, well known in the art. Importantly, as shown in FIG. 1, the first end 22 of conduit 20 is submerged in the liquid phase refrigerant 14 in vessel 12. The second end 24, on the other hand, extends outside the vessel 12 to serve as an exhaust vent for the system 10.

Between its first end 22 and its second end 24, the conduit 20 is formed with two separate functional structures. The first of these structures is a cooling element 26, and the second is a heat exchanger 28. The conduit 20 can also include a first section 29 and a second section 31. The first section 29 extends between the vessel 12 and the cooling element 26 while the second section 31 extends between the cooling element 26 and the heat exchanger 28.

As shown, the cooling element 26 is external to the vessel 12 and may be any particularly desired configuration. Specifically, the conduit 20 may have bends or twists as required for cooling the particular environment 30 into which the cooling element 26 is inserted. For example, the environment 30 may be an MRI System. If so, the cooling element 26 may need to be configured to properly cool an antenna sensor of the MRI System.

The heat exchanger 28 is in thermal contact with the fluid in the vessel 12. Unlike the cooling element 26, the heat exchanger 28 is preferably located inside the vessel 12. Like the cooling element 26, the heat exchanger 28 can have any particularly desired configuration. It is preferable, that at least a portion of the heat exchanger 28 is located in the space 32 above the surface 34 which separates the liquid phase refrigerant 14 from the gas phase refrigerant 16. This is preferred so that the heat exchanger 28 is placed in direct contact with the gas phase refrigerant 16.

As shown in FIG. 1, the heat exchanger 28 is formed as a coil which is positioned along the side walls 36 of the vessel 12. It is to be appreciated, however, that other configurations for the heat exchanger 28 are possible. For example, the heat exchanger 28 can be a coil which extends through the center of the vessel 12. Alternately, the heat exchanger 28 can be positioned near a top of the vessel 12 or near a bottom of the vessel 12. In yet another embodiment, some or all of the heater exchanger 28 can be positioned in the side walls 36 of the vessel 12.

Still referring to FIG. 1 it will be seen that a weight 38 can be attached proximate the first end 22 of conduit 20. The weight 38 is so attached in order to keep the first end 22 submerged in the liquid phase refrigerant 14 in vessel 12 during operation of the system 10. Also shown located proximate the first end 22 of conduit 20 is a fluid flow restrictor 40. For the present invention, the restrictor 40 may be of a any type well known in the pertinent art which will cause a pressure drop in any fluid which passes through the restrictor 40. For example, the restrictor 40 can be a nozzle, an orifice, a permeable medium, a valve, an adjustable valve, or a servo control needle valve. The restrictor 40 acts as a pressure reducer and reduces the pressure of the fluid in the conduit 20.

Figure 2:
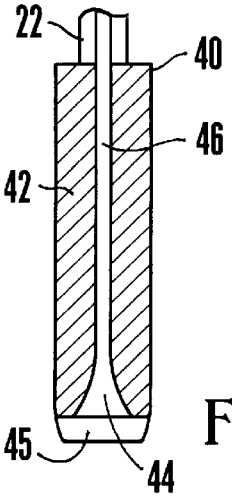
FIG. 2 is a cross-sectional view of a fluid flow restrictor useful for the present invention.

FIG. 2 shows one embodiment for the fluid flow restrictor 40 that can be used for the system 10. For this particular embodiment, the restrictor 40 includes a body portion 42 which, itself, may have sufficient weight to also function as the weight 38. Additionally, the body portion 42 has an opening 44, otherwise referred to as an inlet port, that is covered by a filter element 45 which passes fluid, but prevents debris and/or contaminants (not shown) such as ice (not shown) from entering and clogging the fluid flow restrictor 40.

The opening 44 is in fluid communication with a passageway 46 that is formed longitudinally in the body portion 42. As shown, the passageway 46 is of reduced cross-sectional area, relative to the cross-sectional area of the opening 44, so that fluid passing through the passageway 46 will experience a pressure drop. Importantly, as the fluid pressure drops during passage of the fluid through the passageway 46 of restrictor 40, the temperature of the fluid will also drop. In the context of the present invention, the fluid entering the restrictor 40 is predominantly the liquid phase refrigerant 14. Thus, the liquid phase refrigerant 14 enters conduit 20 at a reduced pressure and temperature in comparison with its pressure and temperature in vessel 12.

In order to maintain the lower temperature for liquid phase refrigerant 14 as it passes through the conduit 20 and out of the vessel 12, the portion 48 of conduit 20 which is proximate the first end 22, and thus inside the vessel 12, is covered with an insulator 50. More specifically, the portion 48 of conduit 20 between the flow restrictor 40 and vessel 12 is covered with the insulator 50. The insulator 50 can be of any type well known in the pertinent art, such as a vacuum insulator. At this point, it is to be noted that both portion 48 of conduit 20, and the insulator 50 surrounding portion 48, are preferably flexible in order to allow free movement of first end 22 for submersion in liquid phase refrigerant 14 as the orientation of the vessel 12 is altered.

It is important to the operation of the system 10 that the liquid phase refrigerant 14 be evaporated in the vessel 12. To accomplish this, some method for heat biasing needs to be provided. One possible method for heat biasing for heating the liquid phase refrigerant 14 for evaporation is to provide a heating element 52. In FIG. 1, the heating element 52 is shown submerged in the liquid phase refrigerant 14. It is to be appreciated that, if a heating source 51 such as heating element 52 is to be used, the actual location of the heating element 52 inside the vessel 12 will be a matter of design preference. For the embodiment shown in FIG. 1, the heating element 52 is connected via a line 54 with a voltage source 56. With such an arrangement, the heating element 52 may be selectively activated, as desired. Stated differently, control over activation of the voltage source 56 can provide for programmed heating of the liquid phase refrigerant 14 in the vessel 12. The heating may then be accomplished according to preprogrammed routines.

In an alternate embodiment for the heat source 51, as implied above, the heating element 52 may be eliminated. If so, the vessel 12 may be covered with a coating 58 which will absorb heat from the surroundings of vessel 12. For this embodiment, if a relatively large heat bias is desired, the coating 58 may be black in color. On the other hand, if a low heat bias is sufficient, the coating 58 may be made of a reflective material. In this embodiment, the heat source 51 is from heat which radiates through the vessel 12.

As provided herein, the heat source 51, the conduit 20, the heat exchanger 28 and the flow restrictor 40 combine to form a regulator 60 which effectively regulates the flow of fluid from the vessel 12 to the cooling element 26.

OPERATION

Figure 3:
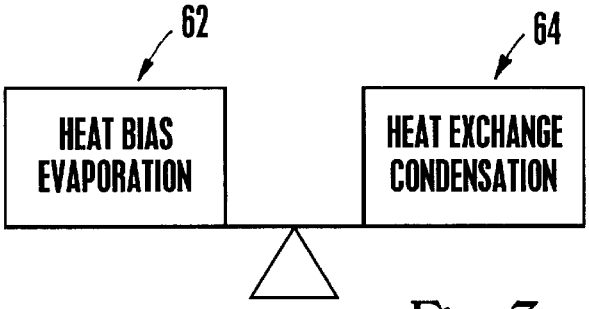
FIG. 3 is a conceptual illustration of the factors affecting equilibrium which balance each other during the operation of the present invention.

During operation of the system 10 of the present invention, a passive feedback control loop is established by the fluid refrigerant as it flows through the conduit 20. As indicated in FIG. 3, the balance for this passive feedback control loop is in the interaction between evaporation of liquid phase refrigerant 62 and the condensation of gas phase refrigerant 64 in the vessel 12.

It will be appreciated by the skilled artisan that as heat is introduced into the vessel 12 by the heat source 51 (e.g., heating element 52) the liquid phase refrigerant 14 will be heated and will assume a stratified temperature profile within the vessel 12. In this profile the warmer liquid phase refrigerant 14 will be efficiently nearest the surface 34. With any heat bias from the heating element 52, a portion of the liquid phase refrigerant 14 will evaporate into the space 32 as gas phase refrigerant 16.

While the heat bias of system 10 is evaporating liquid phase refrigerant 14, the heat exchanger 28 is simultaneously condensing gas phase refrigerant 16 in the vessel 12. Recall, that the fluid refrigerant leaving vessel 12 through the fluid flow restrictor 40 is at a reduced pressure, and at a lower temperature, than the liquid phase refrigerant 14 in vessel 12. Thus, the temperature of the liquid phase refrigerant 14 in conduit 20 will also be below the temperature of the gas phase refrigerant 16 in vessel 12. Accordingly, with conduit 20 designed so that liquid phase refrigerant 14 is still in the conduit 20 as it passes through the heat exchanger 28, thermal communication between the heat exchanger 28 and the gas phase refrigerant 16 in space 32 of vessel 12 will cause the gas phase refrigerant 16 to condense. This condensation will then lower the vapor pressure in space 32.

Importantly, with the unique system 10 provided herein, if the cooling element 26 is insufficiently cooled, the heat exchanger 28 will condense less fluid refrigerant. This will allow the pressure to increase in the vessel 12 and more flow of the fluid to the cooling element 26. On the other hand, if too much fluid is delivered to the cooling element 26, the heat exchanger 28 will condense more of the fluid in the vessel 12. This will result in less pressure in the vessel 12 and less fluid flow to the cooling element 26. Accordingly, the present system 10 is able to maintain equilibrium.

In light of the above, it is instructive to follow the flow of fluid refrigerant through the system 10. Beginning with the liquid phase refrigerant 14 in vessel 12, due to the heat which is added by heating element 52 (or some other heat biasing source) the liquid phase refrigerant 14 evaporates into gas phase refrigerant 16 at the surface 34. This process of evaporation increases the pressure of the gas phase refrigerant 16 in space 32 above the surface 34. This increased pressure, in turn, forces liquid phase refrigerant 14 into and through the fluid flow restrictor 40. As the liquid phase refrigerant 14 passes through the fluid flow restrictor 40, its pressure is reduced and its temperature is lowered. The liquid phase refrigerant 14, now at lower temperature and pressure, exits the vessel 12 while protected by the insulator 50 from heat transfer with the fluid refrigerant in the vessel 12.

Outside the vessel 12, the liquid phase refrigerant 14 passes in conduit 20 through the cooling element 26. While in the cooling element 26, the fluid refrigerant absorbs heat from the environment 30 to thereby cool the environment 30. In this process, some, but not all, of the liquid phase refrigerant 14 will evaporate as gas phase refrigerant 16. Importantly, as the fluid refrigerant leaves the cooling element 26 and enters the heat exchanger 28, at least some of the fluid refrigerant is a liquid phase refrigerant 14. As indicated above, this liquid phase refrigerant 14 in conduit 20 will still be at a temperature which is lower than the temperature of gas phase refrigerant 16 in vessel 12.

At the heat exchanger 28, the liquid phase refrigerant 16 in conduit 20 will be in thermal communication with the gas phase refrigerant 16 in vessel 12. Due to their differences in temperature, heat will flow from the gas phase refrigerant 16 in the vessel 12 to the liquid phase refrigerant 14 in heat exchanger 28. This liquid phase refrigerant 16 will then be further evaporated and all of the fluid refrigerant will be exhausted from the system 10 through the second end 24 of conduit 20. At the same time, as the gas phase refrigerant 16 is cooled by the heat exchanger 28 it will condense and precipitate from space 32 as liquid phase refrigerant 14. This condensed liquid phase refrigerant 14 will either subsequently evaporate and recycle, or exit through conduit 20. In this manner, with proper design of the conduit 20 to account for thermodynamic properties of the fluid refrigerant being used, the system 10 is self-supporting and passively controlled.

While the particular cooling system as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A regulator for regulating flow of a fluid from a vessel holding the fluid to a cooling element, the flow regulator comprising:

a conduit including a first section adapted for transferring at least a portion of the fluid from the vessel to the cooling element;

a pressure reducer adapted to reduce the temperature of the fluid in the conduit; and a heat exchanger adapted to be in thermal communication with at least a portion of the fluid in the vessel, the heat exchanger being adapted to condense at least a portion of a gaseous phase of the fluid;

wherein the conduit includes a second section adapted for transferring at least a portion of the fluid from the cooling element to the heat exchanger.

2. The regulator of claim 1 wherein the first section of the conduit includes an inlet port for being in liquid communication with a liquid phase of the fluid.

3. The regulator of claim 1 wherein the pressure reducer is a flow restrictor positioned in the first section of the conduit for restricting the flow of the fluid in the first section of the conduit.

4. The regulator of claim 3 wherein the flow restrictor is an orifice in the first section of the conduit.

5. The regulator of claim 1 including a heat source adapted for evaporating at least a portion of the fluid in the vessel.

6. The regulator of claim 5 wherein the heat source includes a heating element.

7. The regulator of claim 5 wherein the heat source includes heat radiated through the vessel.

8. The regulator of claim 1 wherein the heat exchanger is in thermal communication with at least a portion of a gaseous phase of the fluid.

9. A system including a vessel for holding the fluid, and the regulator of claim 1.

10. The system of claim 9 including a cooling element.

11. A MRI device including the system of claim 10.

12. A system for providing a fluid to a cooling element, the fluid having a liquid phase and a gaseous phase, the system comprising:

a vessel which is adapted for holding the fluid;

a heat source for evaporating at least a portion of the fluid in the vessel;

a heat exchanger positioned in the vessel and in thermal contact with at least a portion of a gaseous component of the fluid in the vessel;

a conduit including a first section and a second section, the first section being adapted to establish fluid communication between the vessel and the cooling element to transfer at least a portion of the fluid from the vessel to the cooling element, the first section including an inlet port positioned within a liquid phase of the fluid within the vessel, the second section being adapted to establish fluid communication between the cooling element and the heat exchanger to transfer at least a portion of the fluid from the cooling element to the heat exchanger; and a flow restriction within the first section for restricting flow of the fluid in the first section.

13. The system of claim 12 including a cooling element.

14. A system for using a fluid refrigerant to cool an environment which comprises:

a vessel for holding the fluid refrigerant during evaporation from a liquid phase into a gas phase to raise pressure in said vessel;

a conduit for receiving the fluid refrigerant in response to pressure increases in said vessel, said conduit having a first end and a second end with a cooling element and a heat exchanger sequentially formed therebetween, said first end of said conduit being in fluid communication with the liquid phase, and said heat exchanger being at partly in thermal communication with the gas phase; and a fluid flow restrictor mounted between said first end of said conduit and said cooling element to reduce pressure and temperature of the fluid refrigerant passing into said conduit for absorbing heat at said cooling element for cooling the environment, and for absorbing heat from the gas phase at said heat exchanger to condense fluid refrigerant in said vessel.

15. A system as recited in claim 14 wherein the flow restrictor is positioned proximate the first end.

16. A system as recited in claim 14 wherein said vessel has interior walls made of a material having a low thermal conductivity.

17. A system as recited in claim 14 comprising a heating means for evaporating the fluid refrigerant inside the vessel.

18. A system as recited in claim 14 wherein said heat exchanger is formed substantially as a coil with said coil being mounted proximate said interior walls of said vessel.

19. A system as recited in claim 14 wherein at least a portion of said conduit proximate said first end is flexible, and said system further comprises a weighting means at approximately said first end of said conduit to maintain said first end submerged in the liquid phase of the fluid refrigerant during operation of said system.

20. A system as recited in claim 14 wherein said vessel has a wall and a portion of said conduit proximate said first end extends from said wall into said vessel, and wherein said system further comprises a thermal insulator surrounding said portion of said conduit between said wall and said fluid flow restrictor.

21. A system as recited in claim 14 wherein the environment is a sensor for an MRI device.

22. A method for cooling an environment with a fluid refrigerant having a gas phase and a liquid phase, the method comprising the steps of:

evaporating liquid phase refrigerant in a vessel to raise the pressure in the vessel;

discharging fluid refrigerant into a conduit in response to the increased pressure in the vessel;

reducing the pressure of the fluid refrigerant in the conduit to lower the temperature of the fluid refrigerant;

absorbing heat from the environment into the fluid refrigerant in the conduit to cool the environment;

maintaining liquid phase refrigerant in the conduit; and drawing heat from at least a portion of the gas phase refrigerant in the vessel into the fluid refrigerant in the conduit to condense at least a portion of the gas phase refrigerant in the vessel back into liquid phase refrigerant in the vessel;

wherein said drawing step is subsequent to said absorbing step.

23. A method as recited in claim 22 wherein said evaporating step is accomplished using a heating means positioned inside the vessel.

24. A method as recited in claim 22 wherein said reducing step is accomplished using a fluid flow restrictor.

25. A method as recited in claim 22 wherein said conduit is formed with a cooling element and a heat exchanger with said absorbing step being accomplished by said cooling element and said drawing step being accomplished by said heat exchanger.

26. A regulator for regulating flow of a fluid from a vessel holding the fluid to a cooling element, the flow regulator comprising:

a conduit including a first section adapted for transferring at least a portion of the fluid from the vessel to the cooling element, the first section including an inlet port for being in liquid communication with a liquid phase of the fluid;

a pressure reducer adapted to reduce the temperature of the fluid in the conduit; and a heat exchanger adapted to be in thermal communication with at least a portion of the fluid in the vessel, the heat exchanger being adapted to condense at least a portion of a gaseous phase of the fluid.

27. A regulator for regulating flow of a fluid from a vessel holding the fluid to a cooling element, the flow regulator comprising:

a conduit including a first section adapted for transferring at least a portion of the fluid from the vessel to the cooling element;

a pressure reducer adapted to reduce the temperature of the fluid in the conduit, the pressure reducer including a flow restrictor positioned in the first section of the conduit for restricting the flow of the fluid in the first section of the conduit; and a heat exchanger adapted to be in thermal communication with at least a portion of the fluid in the vessel, the heat exchanger being adapted to condense at least a portion of a gaseous phase of the fluid.

28. A regulator for regulating flow of a fluid from a vessel holding the fluid to a cooling element, the flow regulator comprising:

a conduit including a first section adapted for transferring at least a portion of the fluid from the vessel to the cooling element;

a pressure reducer adapted to reduce the temperature of the fluid in the conduit;

a heat exchanger adapted to be in thermal communication with at least a portion of the fluid in the vessel, the heat exchanger being adapted to condense at least a portion of a gaseous phase of the fluid; and a heat source adapted for evaporating at least a portion of the fluid in the vessel.

29. The regulator of claim 28 wherein the heat source includes a heating element.

30. A regulator for regulating flow of a fluid from a vessel holding the fluid to a cooling element, the flow regulator comprising:

a conduit including a first section adapted for transferring at least a portion of the fluid from the vessel to the cooling element;

a pressure reducer adapted to reduce the temperature of the fluid in the conduit; and a heat exchanger adapted to be in thermal communication with at least a portion of a gaseous phase of the fluid in the vessel, the heat exchanger being adapted to condense at least a portion of the gaseous phase of the fluid.

31. A system comprising:

a vessel adapted for holding a fluid; and a regulator for regulating flow of the fluid from the vessel to a cooling element, the flow regulator comprising (i) a conduit including a first section adapted for transferring at least a portion of the fluid from the vessel to the cooling element; (ii) a pressure reducer adapted to reduce the temperature of the fluid in the conduit; and (iii) a heat exchanger adapted to be in thermal communication with at least a portion of the fluid in the vessel, the heat exchanger being adapted to condense at least a portion of the gaseous phase of the fluid.

32. A method for cooling an environment with a fluid refrigerant having a gas phase and a liquid phase, the method comprising the steps of:

evaporating liquid phase refrigerant in a vessel with a heating means positioned inside the vessel to raise the pressure in the vessel;

discharging fluid refrigerant into a conduit in response to the increased pressure in the vessel;

reducing the pressure of the fluid refrigerant in the conduit to lower the temperature of the fluid refrigerant;

absorbing heat from the environment into the fluid refrigerant in the conduit to cool the environment; and drawing heat from at least a portion of the gas phase refrigerant in the vessel into the fluid refrigerant in the conduit to condense at least a portion of the gas phase refrigerant in the vessel back into liquid phase refrigerant in the vessel.

33. A method for cooling an environment with a fluid refrigerant having a gas phase and a liquid phase, the method comprising the steps of:

evaporating liquid phase refrigerant in a vessel to raise the pressure in the vessel;

discharging fluid refrigerant into a conduit in response to the increased pressure in the vessel;

reducing the pressure of the fluid refrigerant in the conduit with a fluid flow restrictor to lower the temperature of the fluid refrigerant;

absorbing heat from the environment into the fluid refrigerant in the conduit to cool the environment; and drawing heat from at least a portion of the gas phase refrigerant in the vessel into the fluid refrigerant in the conduit to condense at least a portion of the gas phase refrigerant in the vessel back into liquid phase refrigerant in the vessel.

34. A method for cooling an environment with a fluid refrigerant having a gas phase and a liquid phase, the method comprising the steps of:

evaporating liquid phase refrigerant in a vessel to raise the pressure in the vessel;

discharging fluid refrigerant into a conduit in response to the increased pressure in the vessel, the conduit having a cooling element and a heat exchanger;

reducing the pressure of the fluid refrigerant in the conduit to lower the temperature of the fluid refrigerant;

absorbing heat from the environment into the fluid refrigerant in the cooling element of the conduit to cool the environment; and drawing heat from at least a portion of the gas phase refrigerant in the vessel into the fluid refrigerant in the heat exchanger of the conduit to condense at least a portion of the gas phase refrigerant in the vessel back into liquid phase refrigerant in the vessel.

35. A regulator for regulating flow of a fluid from a vessel holding the fluid to a cooling element, the flow regulator comprising:

a heat exchanger adapted to be in thermal communication with at least a portion of the fluid in the vessel, the heat exchanger being adapted to condense at least a portion of the gaseous phase of the fluid; and a conduit including a first section and a second section, the first section being adapted for transferring at least a portion of the fluid from the vessel to the cooling element, the second section being adapted for transferring at least a portion of the fluid from the cooling element to the heat exchanger.

* * * * *